US008551390B2

(12) United States Patent
Jun et al.

(10) Patent No.: US 8,551,390 B2
(45) Date of Patent: Oct. 8, 2013

(54) ELECTROSPINNING APPARATUS, METHODS OF USE, AND UNCOMPRESSED FIBROUS MESH

(75) Inventors: Ho-Wook Jun, Hoover, AL (US); Ajay Tambralli, Birmingham, AL (US); Bryan Adam Blakeney, Gulfport, MS (US); Derrick Dean, Montgomery, AL (US)

(73) Assignee: The UAB Foundation, Birmingham, AL (US)

( * ) Notice: Subject to any disclaimer, the term of this patent is extended or adjusted under 35 U.S.C. 154(b) by 163 days.

(21) Appl. No.: 13/081,820

(22) Filed: Apr. 7, 2011

(65) Prior Publication Data

US 2011/0250308 A1 Oct. 13, 2011

Related U.S. Application Data

(60) Provisional application No. 61/323,179, filed on Apr. 12, 2010.

(51) Int. Cl.
*B29C 47/00* (2006.01)

(52) U.S. Cl.
USPC ..... 264/465; 264/10; 264/405; 264/438; 264/467; 264/205; 264/433; 264/484; 264/623; 264/634; 264/638; 264/636; 264/441; 425/378.2; 425/464; 425/174.6; 425/174.8 R; 425/174.8 E; 425/382.2; 425/174

(58) Field of Classification Search
USPC ..... 264/10, 405, 438, 465, 467, 205, 264/433, 484, 623, 634, 638, 636, 441; 425/378.2, 464, 174.6, 174.8 R, 174.8 E, 425/382.2, 174
See application file for complete search history.

(56) References Cited

U.S. PATENT DOCUMENTS

| | | | | |
|---|---|---|---|---|
| 7,959,848 | B2 | 6/2011 | Reneker et al. | |
| 2005/0180992 | A1 | 8/2005 | Belcher et al. | |
| 2009/0061496 | A1 | 3/2009 | Kuhn et al. | |
| 2010/0008994 | A1 | 1/2010 | Reneker et al. | |
| 2011/0039101 | A1 * | 2/2011 | Chang et al. | 264/465 |

FOREIGN PATENT DOCUMENTS

WO WO 2009127166 A1 * 10/2009

OTHER PUBLICATIONS

The International Preliminary Report on Patentability dated Oct. 26, 2012.

* cited by examiner

*Primary Examiner* — Timothy Kennedy
(74) *Attorney, Agent, or Firm* — Thomas Horstemeyer, LLP

(57) ABSTRACT

Embodiments of the present disclosure provide electrospinning devices, methods of use, uncompressed fibrous mesh, and the like, are disclosed.

24 Claims, 7 Drawing Sheets

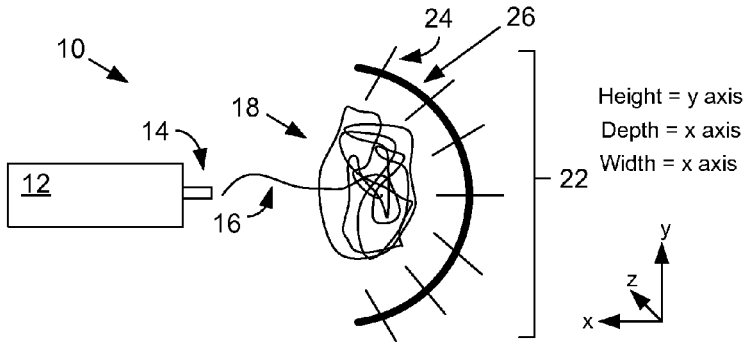
FIG. 1.1
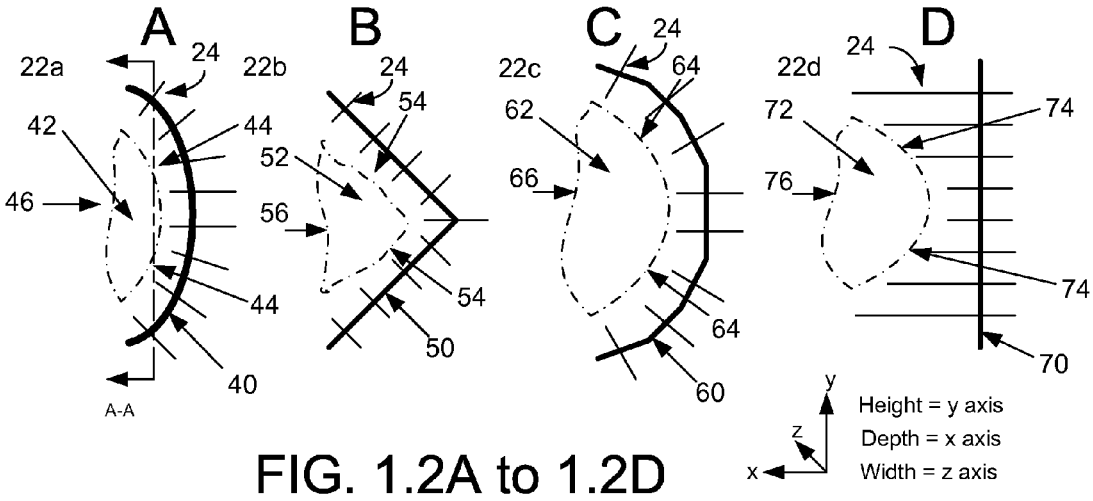
FIG. 1.2A to 1.2D
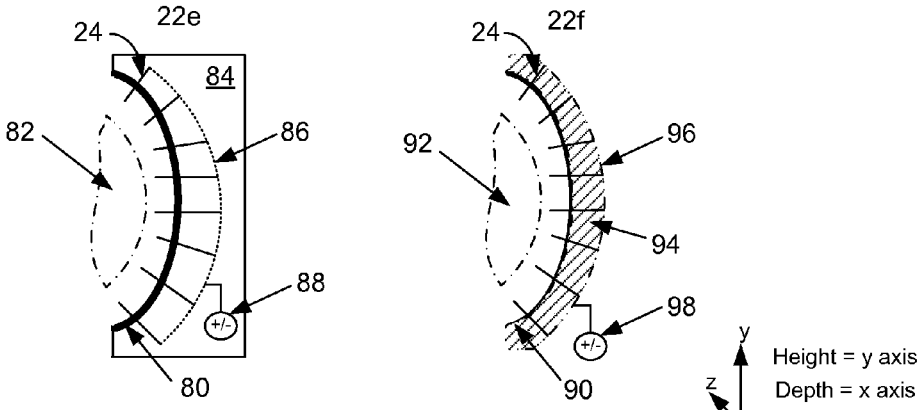
FIG. 1.3A to 1.3B

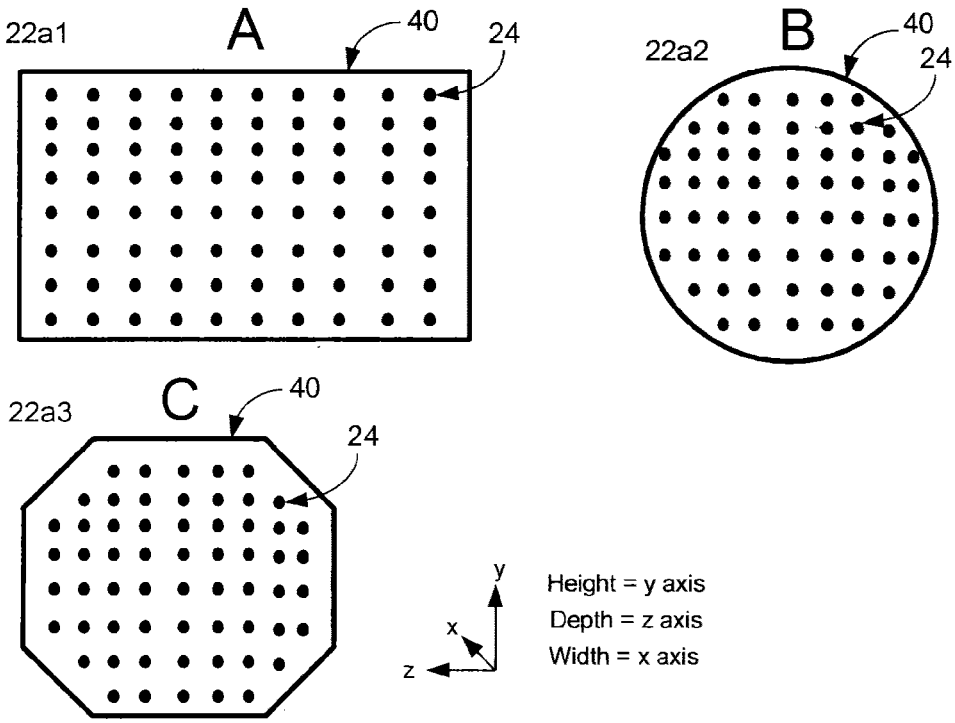
FIG. 1.4A to 1.4C
A-A Cross-section from Fig. 1.2A
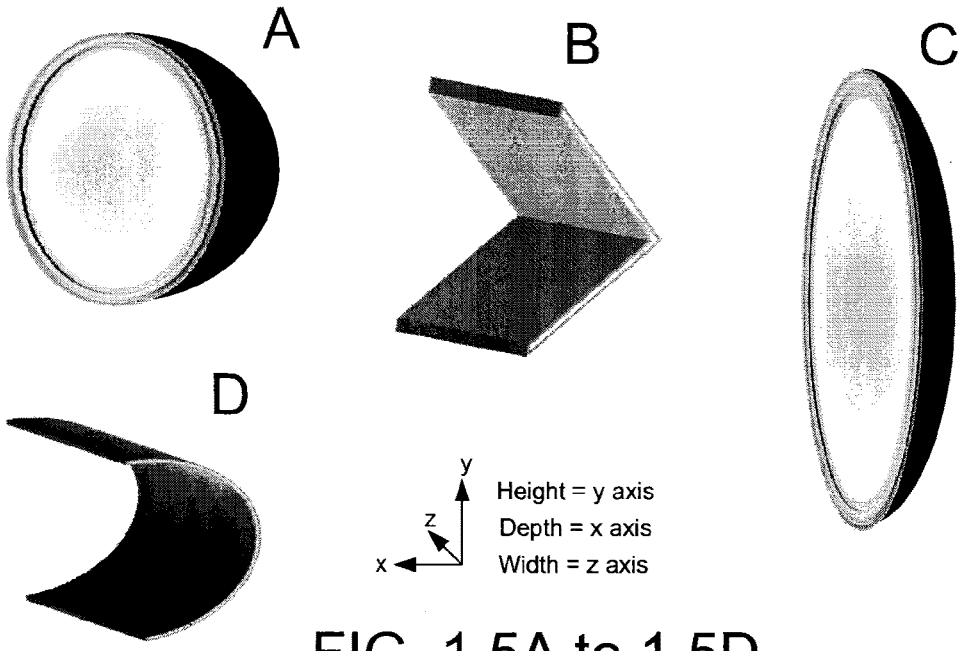
FIG. 1.5A to 1.5D

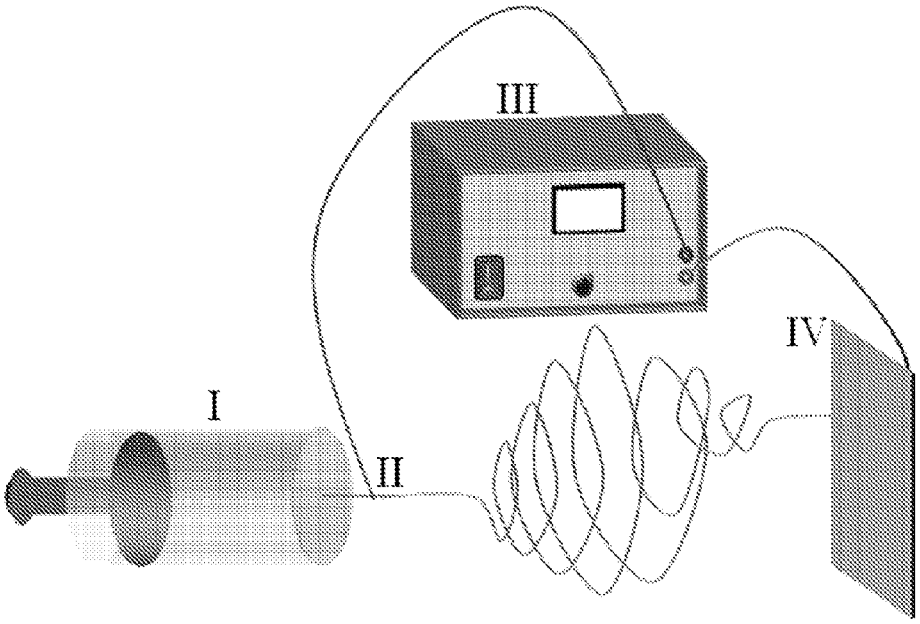
FIG. 2.1A
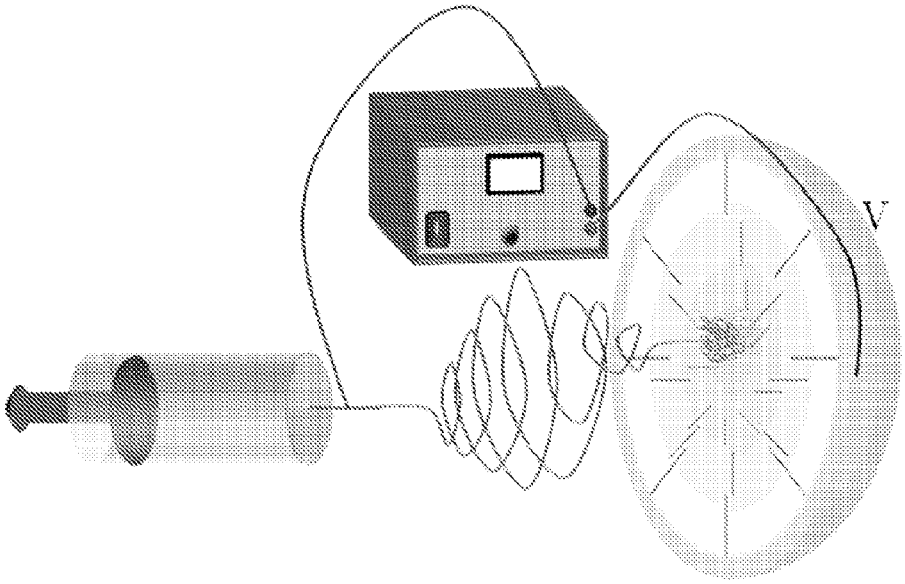
FIG. 2.1B

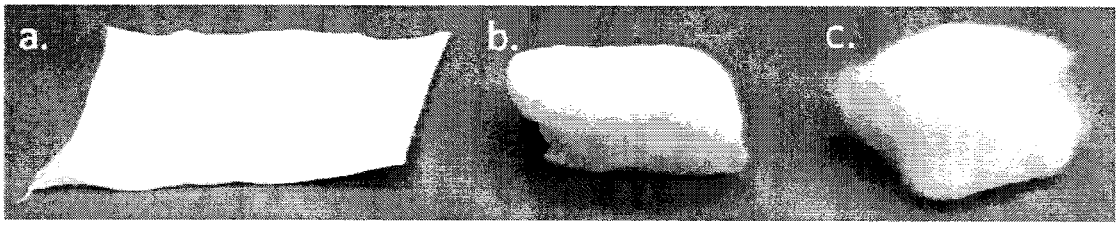
FIG. 2.2A-C
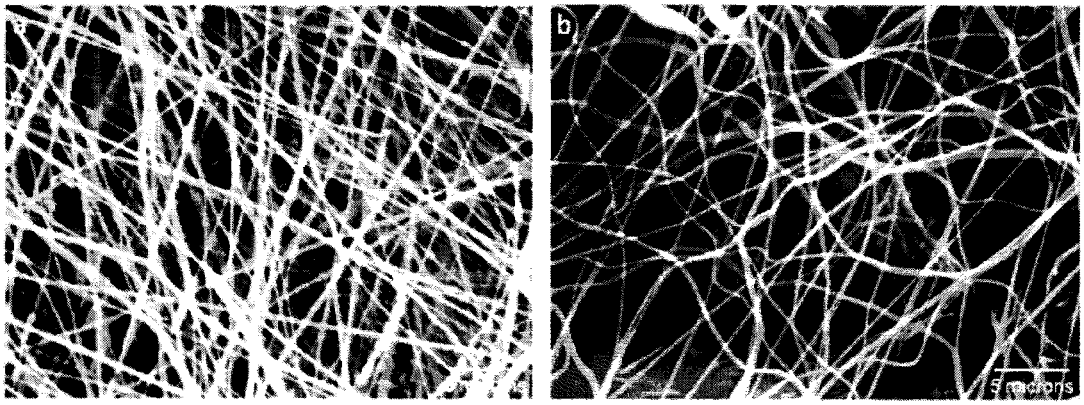
FIG. 2.3

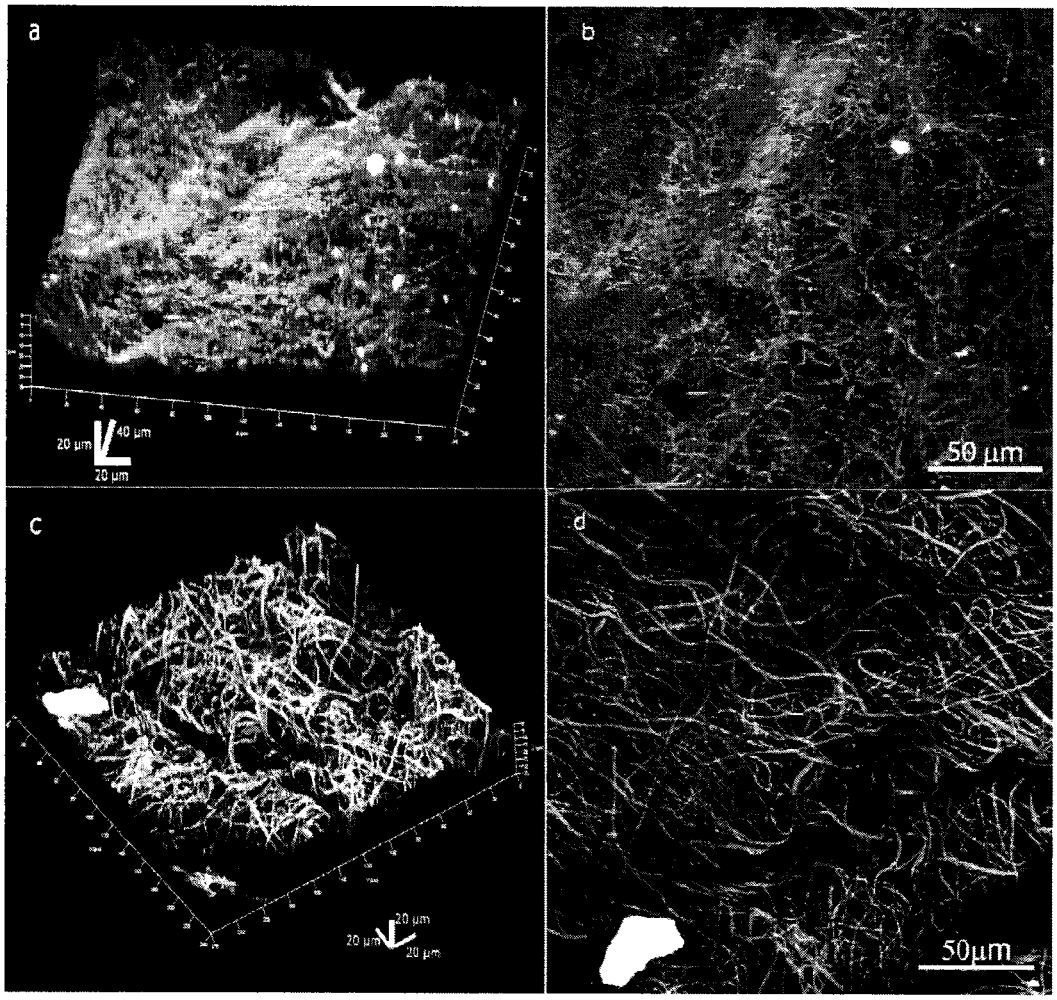
FIG. 2.4

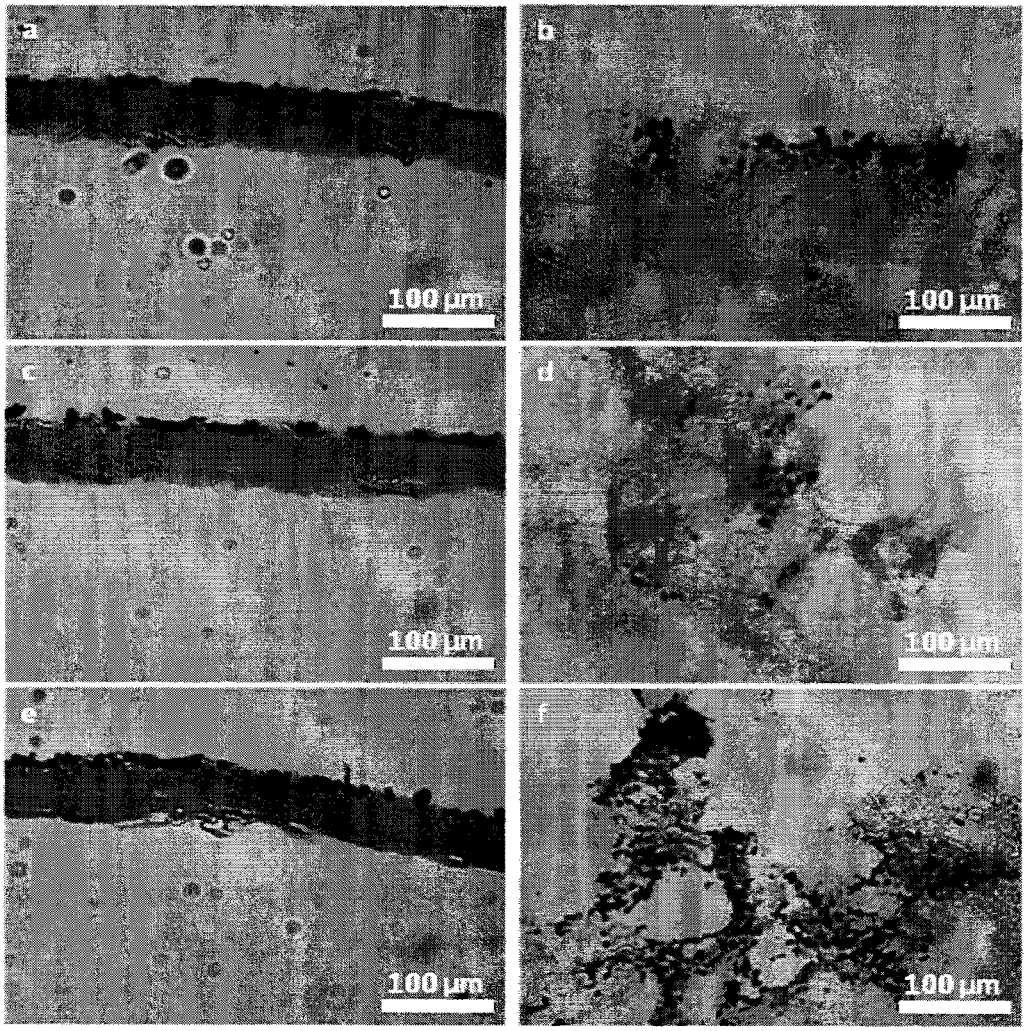
FIG. 2.5

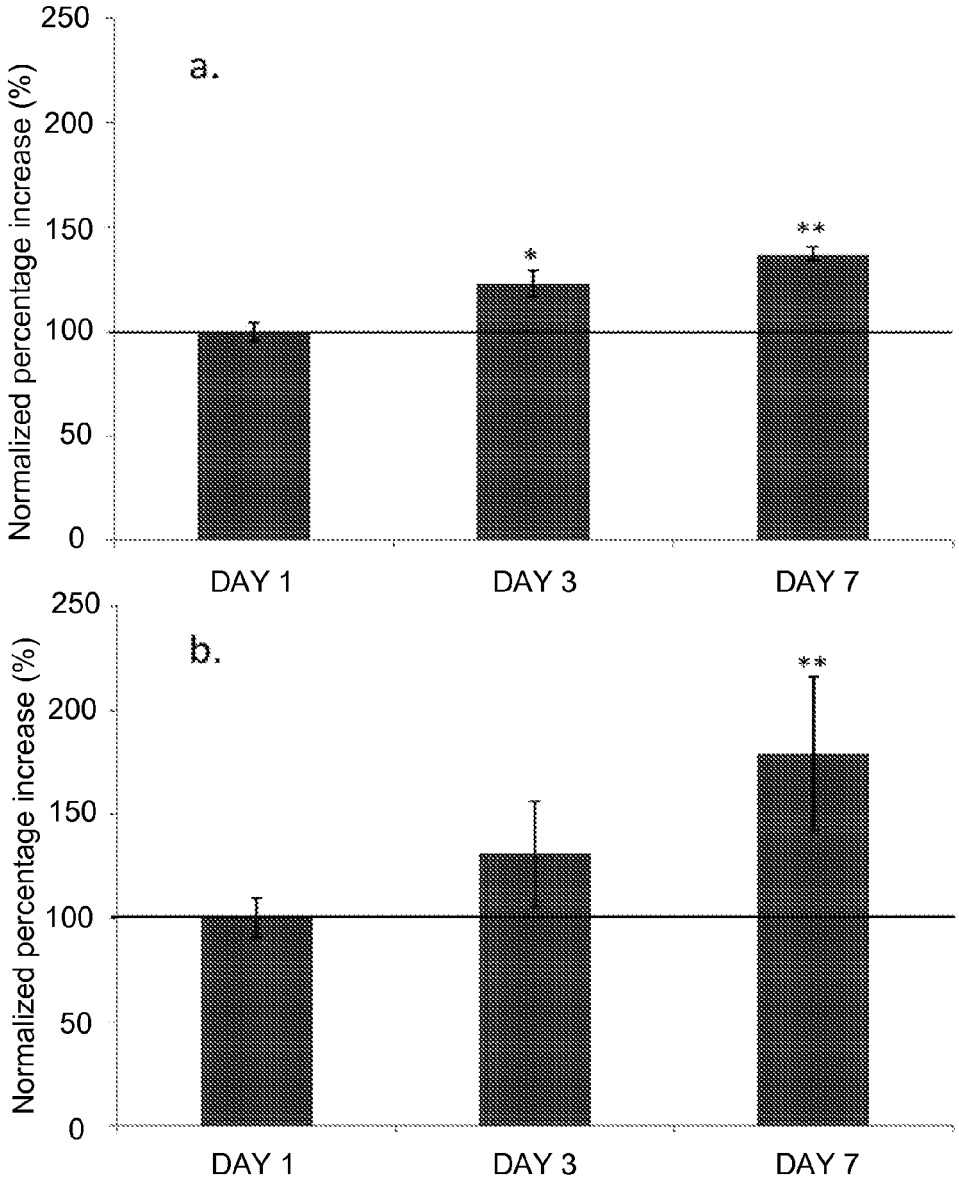
FIG. 2.6

ELECTROSPINNING APPARATUS, METHODS OF USE, AND UNCOMPRESSED FIBROUS MESH

CROSS-REFERENCE TO RELATED APPLICATIONS

This application claims priority to U.S. Provisional Patent Application Ser. No. 61/323,179, entitled "Electrospun Nanofiber Matrix with Cotton-Ball like Three-Dimensional Macroporous Structure" filed on Apr. 12, 2010, which is hereby incorporated by reference.

FEDERAL SPONSORSHIP

This invention was made with Government support under Contract/Grant No. CBET-0952974, awarded by the National Science Foundation (NSF). The Government has certain rights in this invention.

BACKGROUND

Traditional electrospinning produces flat, highly interconnected scaffolds consisting of densely packed nanofibers. These electrospun scaffolds can support the adhesion, growth, and function of various cell types, while also promoting their maturation into specific tissue lineages. However, a major limitation of traditional electrospun scaffolds is that they have tightly packed layers of nanofibers with only a superficially porous network, resulting in confinement to sheet-like formations only. This unavoidable characteristic restricts cell infiltration and growth through the scaffolds. Thus, there is a need to develop an innovative strategy capable of fabricating an electrospun scaffold that overcomes these limitations.

SUMMARY

Embodiments of the present disclosure provide electrospinning devices, methods of use, uncompressed fibrous mesh, and the like, are disclosed.

One exemplary electrospinning apparatus, among others, includes: a device that a fiber is drawn from, wherein the tip of the device from where the fiber is drawn is at a first potential, and a structure that includes a plurality of conductive probes, wherein each probe has a distal end, wherein a portion of each probe extends from a non-conductive surface of the structure, wherein a first set of the distal ends are recessed relative to a second set of distal ends, wherein the first set and the set of distal ends form a first boundary of a target volume, wherein a second boundary of the target volume is not bound by the distal ends of the plurality of the probes, wherein the device is positioned adjacent the second boundary, wherein the conductive probes are at second potential, wherein there is a potential difference between the first potential and the second potential that causes the fiber to be directed to the target volume through the second boundary.

One exemplary method of forming an uncompressed fibrous mesh, among others, includes: applying a potential difference between a tip of a device and a plurality of conductive probes on a structure, wherein each probe has a distal end, wherein a portion of each probe extends from a non-conductive surface of the structure, wherein a first set of the distal ends are recessed relative to a second set of distal ends, wherein the first set and the set of distal ends form a first boundary of a target volume, wherein a second boundary of the target volume is not bound by the distal ends of the plurality of the probes; drawing a fiber from the tip towards the target volume through the second boundary; and forming the uncompressed fibrous mesh in the target volume.

One exemplary structure, among others, includes: an uncompressed fibrous mesh including a fiber, wherein the uncompressed fibrous mesh has a volume that is about 50 to 1800 $cm^3$, wherein the fiber occupies about 5 to 20% of the volume of the uncompressed fibrous mesh.

Other apparatuses, systems, methods, features, and advantages of this disclosure will be or become apparent to one with skill in the art upon examination of the following drawings and detailed description. It is intended that all such additional apparatuses, systems, methods, features, and advantages be included within this description, be within the scope of this disclosure, and be protected by the accompanying claims.

BRIEF DESCRIPTION OF THE DRAWINGS

Further aspects of the present disclosure will be more readily appreciated upon review of the detailed description of its various embodiments, described below, when taken in conjunction with the accompanying drawings.

FIG. 1.1 is an illustration of an embodiment of an electrospinning device.

FIGS. 1.2A to 1.2D illustrate cross-sections of embodiments of the structure.

FIGS. 1.3A and 1.3B illustrate cross-sections of embodiments of the structure.

FIGS. 1.4A to 1.4C illustrates cross-sections of the A-A plane of the structure shown in FIG. 1.2A.

FIGS. 1.5A to 1.5D illustrates perspective views of shapes of the structure without probes.

FIG. 2.1(*a*) illustrates a scheme for traditional electrospinning. FIG. 2.1(*b*) illustrates a scheme for creating a cotton ball-like electrospun scaffold using spherical dish and metal array. The PCL solution in the syringe (I) is ejected from the syringe nozzle (II). The solution is attracted to the grounded collectors by the voltage difference generated by (III). In FIG. 2.1*a* illustrates the electrospun PCL nanofibers accumulate as tightly packed layers on the traditional flat-plate collector (IV), and in FIG. 2.1*b*, the spherical dish collector (V) allows nanofibers to accumulate in a structure resembling a cotton ball.

FIG. 2.2(*a*) illustrates a traditional ePCL scaffold with a flat, two-dimensional structure with no depth for the traditional scaffolds. FIG. 2.2(*b*) illustrates a cotton ball-like ePCL scaffold shows with a fluffy, three-dimensional structure of the scaffolds. FIG. 2.2(*c*) illustrates a cotton ball, which illustrates the relative shape and density of the electrospun nanofibers.

FIG. 2.3(*a*) illustrates a SEM image of traditional ePCL nanofibers collected using a flat sheet with nanofiber diameters between 300-400 nm and pore sizes <1 μm. FIG. 2.3(*b*) illustrates a SEM image of cotton ball-like ePCL nanofibers collected using the spherical dish and metal array collector with nanofiber diameters around 500 nm and pore sizes between 2-5 μm. For both images, magnification is 5000× and scale bars=5 μm.

FIGS. 2.4*a* to 2.4*d* illustrate confocal microscopy images of: FIG. 2.4(*a*), three-dimensional rendering of a traditional ePCL scaffold and FIG. 2.4(*b*), two-dimensional projection of a traditional ePCL scaffold show a tightly packed nanofibrous structure. In contrast, the confocal microscope images of the three-dimensional rendering of a cotton ball-like ePCL scaffold (FIG. 2.4(*c*)) and two-dimensional projection of a cotton ball-like ePCL scaffold show (FIG. 2.4(*d*)) an undense, loosely packed network structure throughout its depth. Scale bar=50 μm.

FIG. 2.5 illustrates images of H&E stained sections of traditional ePCL scaffolds seeded with INS-1 cells after (a) 1 day, (c) 3 days, and (e) 7 days show that cellular infiltration is limited to the top layers of the scaffolds, even after 7 days. Images of H&E stained sections of cotton ball-like ePCL scaffolds after (b) 1 day, (d) 3 days, and (f) 7 days show that there is a progressive infiltration and growth into the scaffolds throughout the 7 days. For all images, section thicknesses=20 μm, magnification=20×, and scale bars=100 μm.

FIG. 2.6 illustrates normalized INS-1 cells growth on (FIG. 2.6(*a*)) the traditional ePCL scaffolds shows a gradual increase in cell number until 7 days: whereas, on (FIG. 2.6(*b*)) the cotton ball-like ePCL scaffolds a dramatic increase in cell number can be seen at Day 7. In both images, the horizontal normalization line has been included to better illustrate the difference in cell growth. *Cell number at Day 3 is significantly greater than at Day 1 ($p<0.05$). **Cell number at Day 7 is significantly greater than at Days 1 and 3 ($p<0.05$). Error bars represent means±standard deviation. n=4

DETAILED DESCRIPTION

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of flow electrochemistry, material science, chemistry, and the like, which are within the skill of the art.

The following examples are put forth so as to provide those of ordinary skill in the art with a complete disclosure and description of how to perform the methods and use the probes disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise.

Definitions

"Electrospinning" is a process in which fibers are formed from a solution or melt by streaming an electrically charged solution or melt through a hole across a potential gradient.

"Electrospun material" is any molecule or substance that forms a structure or group of structures (such as fibers, webs, or droplet), as a result of the electrospinning process. This material may be natural, synthetic, or a combination of such.

"Polymer" is any natural or synthetic molecule which can form long molecular chains, such as polyolefin, polyamides, polyesters, polyurethanes, polypeptides, polysaccharides, and combinations thereof. In particular, the polymer can include: poly (ϵ-caprolactone), poly vinyl alcohol, polylactic acid, poly(lactic-co-glycolic) acid, poly(etherurethane urea), collagen, elastin, chitosan, or any combination of these.

Discussion

Embodiments of the present disclosure provide electrospinning devices, methods of use, and uncompressed fibrous mesh. Embodiments of the present disclosure are advantageous because they can produce uncompressed, highly porous, thick fibrous meshes using an electrospinning device. In general, embodiments of the present disclosure are capable of collecting fiber(s) in a volume adjacent conductive probes extended from a non-conductive surface (e.g., in mid-air), where the network of fiber(s) resemble a small cotton-ball with its fluffy appearance. Embodiments of the present disclosure allow for the capturing of uncompressed fiber(s) so that the resulting structure is highly porous (e.g., has a pore diameter of about 2 μm or more). In an embodiment, the density is low enough for cells to disperse into the mesh (e.g., density of about 30-200 $kg/m^3$), but mechanically stable enough support a tissue culture. Embodiments of the mesh can be used as a scaffold or container for materials such as cell culture, cell delivery, and/or drug delivery. In another embodiment, the mesh can be used as a filter, sponge, or a substrate that can include molecules of interest. Additional advantages and aspects of embodiments of the present disclosure will be described below and in the Example.

In general, an electrospinning device can include a device (e.g., syringe) and a collection structure. The device is positioned adjacent (e.g., facing the collection structure) collection structure so that fibers can be drawn out of a tip of the device (e.g., tip of the syringe, which is known in the art) or other device across a gap (e.g., distance of cms to 10s of cms) between the device and the collection structure toward the collection structure based on the potential difference between the tip and the collection structure. In an embodiment, two or more devices can feed fiber to the collection structure from different positions to produce a blend of fibers in the mesh. The fiber can be made of polymers as described herein. In an embodiment, the fiber can be a nanofiber and can have a diameter of about 1 to 1000 nm, about 1 nm to 500 nm, about 10 nm to 300 nm, or about 50 nm to 200 nm. An electric field (e.g., about 1 kV/cm to 3 kV/cm) is produced between the device and the collection structure using appropriate electronic systems. The potential difference between the device and the collection structure (e.g., conductive probes) is about 5 kV to 60 kV or about 20 kV, while the distance between the device and the collection structure is about 5 cm to 30 cm. The potential difference can vary depending on the various distances and dimensions as well as polymers used to make the fiber.

FIG. 1.1 is an illustration of an embodiment of an electrospinning device 10. The electrospinning device 10 includes a device 12 that feeds a fiber 16 and a collection structure 22. The device 12 includes a tip 14 (e.g., tip of a syringe) that is adjacent the collection structure 22. One or more fibers of the same or different types of polymers can be drawn from the device 12. In an embodiment, one or both of the device and the collection structure 22 can be moved relative to the other to produce the fibrous mesh 18.

In an embodiment, the collection device 22 can include a nonconductive structure 26 having a plurality of conductive probes 24. Each probe 24 has a distal end extending out of the nonconductive structure 26 on the side closest the device 12 and ends to a tip of the probe 26. A portion of each probe 24 extends a distance from the surface of the nonconductive structure 26 of the structure. In an embodiment, the distal ends of the probes 24 can be considered as two or more sets of distal ends, where each set can include 1, 10, 100, 1000, 10,000 or more distal ends. In an embodiment, a first set of the distal ends are recessed relative to a second set of distal ends (e.g., forming a concave three dimensional volume). The first set and the set of distal ends form a first boundary 44 (See FIG. 1.2A) of a target volume 42 and a second boundary 46 of the target volume 42 is not bound by the distal ends of the plurality of the probes 24. The device 12 is positioned adjacent (e.g., about 2 to 30 cm) the second boundary 46. In an embodiment, the uncompressed fibrous mesh 18 is substantially (e.g., about 50%, about 60%, about 70% about 80%, about 90%, or more, of the uncompressed fibrous mesh 18) formed in the target volume 42. The target volume, first boundary, and the second boundary, were not included in FIG. 1.1 for reasons of clarity. Reference is made to FIG. 1.2A to show the relative location of the target volume, first boundary, and the second boundary, albeit the collection structure shown in FIG. 1.1 and FIG. 1.2A are different. Thus, reference to the target volume, first boundary, and the second boundary in FIG. 1.2A should not limit the target volume, first boundary, and the second boundary in FIG. 1.1.

In an embodiment, the collection device can include a nonconductive structure having only one or a few conductive probes. The one or more probes can define the first boundary as described herein. In another embodiment, the collection device can include a nonconductive structure having one or more areas on the nonconductive structure that are conductive (but no probes extending from the surface as in FIG. 1.1). The conductive portion can form the first boundary as described herein.

The probes 24 can be set at the same or different potentials relative to one another. The plurality of probes 24 can include about 0.1 to 4 or about 0.25 to 1, probes per square cm. The distance between each probe 24 or among the probes 24 can be about 0.25 to 10 cm or about 1 to 5 cm. The distance that each probe 24 extends from the surface of the nonconductive structure 26 can be the same or different, where the distance can be about 0.5 to 10 cm or about 1 to 6 cm. The probes 24 can have a diameter of about 100 μm to 0.5 cm or about 500 μm to 1 mm. In an embodiment, the probe 24 can be tapered so that the tip of the distal end of the probe 24 is either thinner or thicker than the remaining portion of the probe 24. The probe 24 can be made of or is coated with a conductive material such as steel, nickel, aluminum, precious metals (e.g., gold, silver, platinum, copper, and the like) or a combination thereof. In an embodiment, the probe 24 can be designed so that only a portion of the surface of the distal end of the probe 24 is conductive (e.g., only the tip of the probe), and the remaining surface is covered with a nonconductive material, although the probe 24 is conductive. In general the tips of the probes 24 are directed to the target volume 42.

The configuration of the distal ends of the probes forms an electric field that the fiber passes into, thus the electric field formed as a result of the configuration of the distal ends define at least a portion of or the entire target volume and focuses the fiber into the target volume. The design of the embodiments of the present disclosure greatly reduces the density of fibers that would accumulate on a traditional flat surface.

The structure and dimensions (e.g., thickness) of the nonconductive structure 26 can be very depending upon the collection structure 22. In an embodiment, the nonconductive structure 26 can be thin (e.g., thick enough to separate a conductive and the nonconductive structure 26) or thick (e.g., encompassing a large portion of the collection device 22). The structure and the dimensions of the nonconductive structure 26 can vary upon the application. A number of embodiments of the nonconductive structure 26 are described herein and in the Figures. In an embodiment, the nonconductive structure 26 can be a thin material that separates the nonconductive structure 26 from a conductive surface underneath the nonconductive structure 26. In an embodiment, the nonconductive structure 26 can be a self-supported thin material where an open area (without any material) is behind the nonconductive structure 26. The nonconductive structure 26 can be made of a material such as foams, plastics, rubber, wood products, and combinations thereof. The height (y-axis) of the nonconductive structure 26 can be about 5 to 10 cm or about 20 to 50 cm. The depth x-axis) of the nonconductive structure 26 can be about 5 to 75 cm, about 20 to 50 cm, or about 15 to 35 cm. The width (z-axis) of the nonconductive structure 26 can be about 5 to 100 cm. Additional details regarding the collection structure will be described below. The thickness of the nonconductive structure 26 can be about a nanometer to 10 or more centimeters (e.g., about 20, about 30, about 40, or about 50 cm), and can be selected based on the design of the device. When the nonconductive structure 26 is flat, the thickness is about a nanometer to 10 or more centimeters (e.g., about 20, about 30, about 40, or about 50 cm) and can vary in the x-, y-, and/or z-direction.

FIGS. 1.2A to 1.2D illustrate cross-sections of embodiments of the collection structure 22*a*, 22*b*, 22*c*, and 22*d*, respectively. FIG. 1.2A illustrates a nonconductive structure 40 that includes a plurality of probes 24, where the distal ends of the probes 24 extend from the nonconductive structure 40. The distal ends define a target volume 42. The target volume 42 includes a first boundary 44 defined by the distal ends of the probes 24. A second boundary 46 is on the side closest to the where the device 12 (not shown) would be located. The nonconductive structure 40 has a substantially C-type cross-section, and in three-dimensions could be a semi-spherical shape.

FIG. 1.2B illustrates a nonconductive structure 50 that includes a plurality of probes 24, where the distal ends of the probes 24 extend from the nonconductive structure 50. The distal ends define a target volume 52. The target volume 52 includes a first boundary 54 defined by the distal ends of the probes 24. A second boundary 56 is on the side closest to the where the device 12 (not shown) would be located. The nonconductive structure 50 has a substantially V-type cross-section, and in three-dimensions could be a cone shape.

FIG. 1.2C illustrates a nonconductive structure 60 that includes a plurality of probes 24, where the distal ends of the probes 24 extend from the nonconductive structure 60. The distal ends define a target volume 62. The target volume 62 includes a first boundary 64 defined by the distal ends of the probes 24. A second boundary 66 is on the side closest to the where the device 12 (not shown) would be located. The nonconductive structure 60 has a substantially C-type cross-section, where the "C" is not a smooth curve, rather a number of straight portions connected to one another at angles to that set of straight portions forms a substantially C-type cross-section.

FIG. 1.2D illustrates a nonconductive structure 70 that includes a plurality of probes 24, where the distal ends of the probes 24 extend from the nonconductive structure 70. The distal ends define a target volume 72. The target volume 72 includes a first boundary 74 defined by the distal ends of the probes 24. A second boundary 76 is on the side closest to the where the device 12 (not shown) would be located. The nonconductive structure 70 is flat having probes 26 of different lengths extending from the nonconductive structure 70.

An embodiment of the target volume (e.g., some are shown in FIGS. 1.2A to 1.2D) can have a first boundary of the target volume having a cross-sectional shape such as: a substantially concave shape, a substantially cone shape, a substantially hemi-spherical shape, a substantially semi-spherical shape, an arcuate shape, a semi-polygonal shape, a substantially V-shape (FIG. 1.2B), a substantially C-shape (FIG. 1.2A and C), and a substantially U-shape. In an embodiment the three-dimensional shapes of the foregoing cross-sections can vary considerable, for example, the three-dimensional shape could extend the cross-section along the width (z-axis) for a specific distance and the height and depth are held constant so that cross-sections taken along the width are the same. In another example, the three-dimensional shape could extend the cross-section along the width (z-axis) for a specific distance and then height and/or depth can be changed so that cross-sections taken along the width are different. In this regard, the first boundary of the target volume has a three dimensional shape such: as a substantially cone shape, a substantially hemi-spherical shape, and a substantially semi-spherical shape. In each of the shapes above, a first set of the distal ends are further away from the tip of the structure than a second set of the distal ends. The word "substantially" used to modify the shape can include the actual shape as well as modifications to the shape such as a smooth curve (FIG. 1.2A); a set of connected straight portion that can be aligned at angles to form an arcuate surface (FIG. 1.1C); and/or about 50%, about 60%, about 70%, about 80%, about 90%, about 95%, or about 100%, of the original shape. In other words, the shape can vary greatly, but all the shapes have a recessed portion relative to the tip of the device so that the fiber(s) are drawn into a target volume.

An embodiment of the non-conductive structure (e.g., some are shown in FIGS. 1.2A to 1.2D) can have a cross-sectional shape such: as a substantially concave shape, a substantially cone shape, a substantially hemi-spherical shape, a substantially semi-spherical shape, an arcuate shape, a semi-polygonal shape, a substantially V-shape (FIG. 1.2B), a substantially C-shape (FIG. 1.2A and C), and a substantially U-shape. In an embodiment the three-dimensional shapes of the foregoing cross-sections can vary considerably, for example, the three-dimensional shape could extend the cross-section along the width (z-axis) for a specific distance and the height and depth are held constant so that cross-sections taken along the width are the same. In another example, the three-dimensional shape could extend the cross-section along the width (z-axis) for a specific distance and then height and/or depth can be changed so that cross-sections taken along the width are different. In this regard, the non-conductive structure has a three dimensional shape such as: a substantially cone shape, a substantially hemi-spherical shape, and a substantially semi-spherical shape. In each of the shapes above, a first set of the distal ends are further away from the tip of the structure than a second set of the distal ends. The word "substantially" used to modify the shape can include the actual shape as well as modifications to the shape such as a smooth curve (FIG. 1.2A); a set of connected straight portion that can be aligned at angles to form an arcuate surface (FIG. 1.1C); and/or, about 50%, about 60%, about 70%, about 80%, about 90%, about 95%, or about 100%, of the original shape. In other words, the shape can vary greatly, but all the shapes have a recessed portion relative to the tip of the device so that the fiber(s) are drawn into a target volume.

In an embodiment, the target volume has a longest dimension and a second dimension that is perpendicular to the longest dimension at the widest point, wherein the longest dimension is about 5 to 50 cm and the second dimension is about 3 to 50 cm and the target volume is about 15 to 2500 $cm^3$.

FIGS. 1.3A and 1.3B illustrate cross-sections of embodiments of the structure 22*e* and 22*f*. FIG. 1.3A illustrates a nonconductive structure 80 that includes a plurality of probes 24, where the distal ends of the probes 24 extend from the nonconductive structure 80. The distal ends define a target volume 82. The probes 24 are connected to a potential source 88 (e.g., power supply) via an electrical connection 86 (e.g., a wire). The electrical connection 86 is connected to the probes 24 on the side of the nonconductive structure 80 opposite the target volume 82. The nonconductive structure 80 can be disposed in holding structure 84, where the probes 24 are not touching anything other than the electrical connection (e.g., free standing in air).

FIG. 1.3B illustrates a nonconductive structure 90 that includes a plurality of probes 24, where the distal ends of the probes 24 extend from the nonconductive structure 90. The distal ends define a target volume 92. The probes 24 are connected to a potential source 98 (e.g., power supply) via an electrical connection 96 (e.g., a wire). The electrical connection 96 is connected to the probes 24 on the side of the nonconductive structure 90 opposite the target volume 82.

The nonconductive structure 90 is disposed on a support material 94 (e.g., plastic, foam, wood materials, rubber, and a combination thereof), wherein the probes 24 extend through the support material 94 to contact the electrical connection 96.

FIGS. 1.3A and 1.3B illustrate only two possible configurations of the present disclosure. It should be noted that multiple electrical connections can be used to connect sets of the probes to different potential sources so that different potentials can be applied (e.g., where the potentials are held constant or varied (e.g., to control the formation of the mesh).

FIGS. 1.4A to 1.4C illustrate cross-sections of the A-A plane of the structure shown in FIG. 1.2A and these views are recited as 22*a*1, 22*a*2, and 22*a*3, respectively. FIGS. 1.4A to 1.4C illustrate that the dimensions of the nonconductive structure 40 can vary and that the number of probes 24 can vary. FIGS. 1.5A to 1.5D illustrate perspective views of shapes of the collection structure without probes. Thus, FIGS. 1.1 to 1.3B show only a cross-section of the collection structure, but FIGS. 1.4A to 1.5D show that the cross-sections can be extended into three-dimensions in a number of ways to produce a variety of collection structures. The design and selection of the collection structure can be guided by the desired three-dimensional shape, porosity, dimensions, and the like of the fiber mesh.

As described briefly above, an embodiment of the present disclosure includes forming a fibrous mesh using an electrospinning device as described herein. The method includes applying a potential difference between a tip (e.g. a positive bias) of a device and a plurality of conductive probes (e.g., at ground) on a structure. A fiber (e.g., nanofiber) is drawn from the tip towards the target volume through the second boundary to form the uncompressed fibrous mesh. In an embodiment, a single fiber of a single material can be used to make the fibrous mesh or a single fiber made of different materials as a function of the length of the fiber can used. In another embodiment, multiple fibers from one or more tips using the same or different materials can be used to form (e.g., simultaneously or sequentially) the fibrous mesh. Additional details regarding parameters such as the potentials, materials, and the like are described herein and in the Example.

An embodiment of the uncompressed fibrous mesh can include one or more fibers (e.g., nanofibers and/or microfibers (e.g., 500 nm to about 500 μm)) made of one or more materials. The uncompressed fibrous mesh includes space (e.g., about 85%, about 95%, or more or the volume of the mesh) for air or a fluid within the fibrous mesh, whereas a compressed fibrous mesh has most (e.g., more than 90%, 95%, or 99%) of the space for air or fluid is removed. In an embodiment, adjacent layers of the fibrous mesh are not touching one another and space (e.g., air or fluid) can be disposed between the layers for the uncompressed fibrous mesh. In an embodiment, the uncompressed fibrous mesh can include about 5 to 15% fiber, where the uncompressed fibrous mesh has a volume that is about 50 $cm^3$ to 1800 $cm^3$. In an embodiment, the amount of fiber occupies about 5 to 20% of the volume of the uncompressed fibrous mesh. In an embodiment, uncompressed fibrous mesh has a longest dimension, a second dimension that is perpendicular the longest dimension at the widest point, and a third dimension that is perpendicular the longest and second dimensions, where the longest dimension is about 1 to 15 cm, the second dimension is about 1 to 15 cm, and the third dimension is about 1 to 10 cm. In an embodiment, the uncompressed fibrous mesh has a porosity of about 80 to 90%.

EXAMPLES

While embodiments of the present disclosure are described in connection with the Examples and the corresponding text and figures, there is no intent to limit the disclosure to the embodiments in these descriptions. On the contrary, the intent is to cover all alternatives, modifications, and equivalents included within the spirit and scope of embodiments of the present disclosure.

Example 1

Brief Introduction

A limiting factor of traditional electrospinning is that the electrospun scaffolds include entirely of tightly packed nanofiber layers that only provide a superficial porous structure due to the sheet-like assembly process. This unavoidable characteristic hinders cell infiltration and growth throughout the nanofibrous scaffolds. Numerous strategies have been tried to overcome this challenge, including the incorporation of nanoparticles, using larger microfibers, or removing embedded salt or water-soluble fibers to increase porosity. However, these methods still produce sheet-like nanofibrous scaffolds, failing to create a porous three-dimensional scaffold with good structural integrity. Thus, we have developed a three-dimensional cotton ball-like electrospun scaffold that includes an accumulation of nanofibers in a low density and uncompressed manner. Instead of a traditional flat-plate collector, a grounded spherical dish and an array of needle-like probes were used to create a Focused, Low density, Uncompressed nanoFiber (FLUF) mesh scaffold. Scanning electron microscopy showed that the cotton ball-like scaffold includes electrospun nanofibers with a similar diameter but larger pores and less dense structure compared to the traditional electrospun scaffolds. In addition, laser confocal microscopy demonstrated an open porosity and loosely packed structure throughout the depth of the cotton ball-like scaffold, contrasting the superficially porous and tightly packed structure of the traditional electrospun scaffold. Cells seeded on the cotton ball-like scaffold infiltrated into the scaffold after 7 days of growth, compared to no penetrating growth for the traditional electrospun scaffold. Quantitative analysis showed approximately a 40% higher growth rate for cells on the cotton ball-like scaffold over a 7 day period, possibly due to the increased space for in-growth within the three-dimensional scaffolds. Overall, this method assembles a nanofibrous scaffold that is more advantageous for highly porous interconnectivity and demonstrates great potential for tackling current challenges of electrospun scaffolds.

Introduction:

Traditional electrospinning produces flat, highly interconnected scaffolds consisting of densely packed nanofibers. These electrospun scaffolds can support the adhesion, growth, and function of various cell types, while also promoting their maturation into specific tissue lineages, such as bone [1-3], cartilage [4], tendons, ligaments [5], skin [6,7], neurons [8], liver [9], smooth muscle [10], striated muscle [11, 12], and even cornea [13]. In addition, the morphology of electrospun nanofibrous scaffolds is highly tunable by simply modifying any number of fabrication parameters, such as concentration of polymer solution or voltage between nozzle and collector [14]. This is very advantageous for tissue engineering systems because it has been shown that the fiber diameter [15], pore size [16], and even solvent used [17] affect cellular response to electrospun biomaterials. However, a major limitation of traditional electrospun scaffolds is that they have tightly packed layers of nanofibers with only a superficially porous network, resulting in confinement to sheet-like formations only. This unavoidable characteristic restricts cell infiltration and growth through the scaffolds. Thus, it is imperative to develop an innovative strategy capable of fabricating an electrospun scaffold with a stable three dimensional structure, while exhibiting nanofibrous morphologies and deep, interconnected pores. Such a scaffold would better mimic the configuration of native extracellular matrix (ECM), thereby maximizing the likelihood of long-term cell survival and generation of functional tissue within a biomimetic environment.

The techniques used for traditional electrospinning employ a static, flat-plate collector placed at a set distance away from a charged nozzle containing a polymer solution. The resulting electrospun scaffolds are composed of nanofibrous layers arranged in a tightly packed conformation, which allows cellular growth and infiltration near the superficial surface but not deep within the internal structure. Many potential solutions have been investigated to improve this scaffold deficiency; however, the paradoxical nature of the electrospinning process works against achieving an ideal formation that allows for both good cell attachment and deep cellular infiltration. Specifically, as the fiber diameter decreases to the nanoscale range for optimal cell attachment, the porosity decreases as well, thereby preventing deep cellular infiltration that is most easily overcome by reverting back to microscaled fiber diameters [18]. This drawback has previously discouraged exclusively electrospun scaffolds, and has led to exploration of other electrospun nanofiber uses, such as coatings for more porous scaffold material including microfibers [19].

Of the previous methods explored for improving cellular infiltration, one common strategy utilizes salts dissolved in the polymer solution to create specific pore sizes throughout the scaffold by leaching out the particulates after electrospinning [20, 21]. This forms porous spaces in the scaffold; however, the spaces act as a divider for creating separate layers within the scaffold, much like layering multiple scaffolds [22, 23], which does not provide uniform morphology and stability. Another previous strategy involves co-electrospinning the desired polymer with an easily water-soluble material and then dissolving it out [24]. This removes continuous sections within the scaffold; however, the sudden removal of these fibers causes reorganization and contraction of the fibers, which often leads to blockage of the newly created pores [16] and collapses the mesh network of the scaffold [25]. Another approach is to electrospray hydrogels into the scaffold as it is being formed [25]. This creates pockets of hydrogels through which cells can infiltrate deep into the scaffold. However, this method does not produce a true three-dimensional scaffold with interconnected pores because the sprayed hydrogel is difficult to disperse evenly, again leading to a non-uniform scaffold that is unlikely to induce consistent growth throughout. In addition, using rotating drums as collectors creates a hollow shape; however, it still collects nanofibers as tightly packed layers [26].

The main reason that the above methods do not completely overcome the current challenges of electrospun scaffolds is because they are adaptations of the traditional electrospinning technique. Thus, for all current modification methods, the creation of an electrospun nanofiber involves a bead of polymer solution being drawn into a nanoscale fiber due to the applied electric charge. As the nanofiber is dispersed, it then follows the electric potential gradient from the highest (charged nozzle) to the lowest (grounded voltage source), leading to deposition on the nearby collector. As a result of this force, subsequent fiber layers are deposited one on top of the other as two dimensional formations that ultimately form a densely packed structure. Therefore, even though each deposited layer can be viewed as having pores within a planar, two dimensional space, these pores do not continue into the cross-section orthogonal to the layers (i.e., depth of the scaffold), limiting cellular infiltration to only the superficial layers.

Overall, all current strategies to create electrospun scaffolds collect nanofibers in an unfocused, planar manner, which causes subsequent layers to adopt a densely packed network and prevents the formation of three dimensional structures with good stability. Therefore, to overcome these obstacles, we hypothesize that electrospun scaffolds can be fabricated as three dimensional structures if the nanofibers are allowed to accumulate in a more open space that still maintains a focused shape, without forcing the fibers to deposit side-by-side. In this Example, we demonstrate an innovative strategy for creating a Focused, Low density, and Uncompressed nanoFibrous (FLUF) mesh by using a collection system consisting of an array of metal probes embedded in a non-conductive spherical dish. This encourages the electrospun nanofibers to intertwine and accumulate in the air between the probes, while the spherical dish focuses them into a constrained area. This combination results in the electrospun nanofibers adopting a shape similar to a cotton ball with excellent three dimensional structural stability.

Materials and Methods:

Material Fabrication

Electrospinning Traditional Flat-Plate Electrospun Scaffolds

Poly-e-caprolactone (PCL) pellets ($M_n$: 80,000; Sigma Aldrich, St. Louis, Mo.) were dissolved at a ratio of 225 mg/ml in a solvent solution of 1:1 (v:v) chloroform and methanol under constant stirring until the mixture was clear, viscous, and homogenous. PCL solution was poured into a syringe capped with a 25 gauge blunt-tipped needle nozzle. The syringe was loaded into a syringe pump (KD Scientific, Holliston, Mass.) with a set flow rate of 1.0 ml/hr. The flat-plate electrospun scaffolds were then fabricated by traditional methodology as previously described [27]. Briefly, the nozzle was placed 28 cm from a grounded, flat sheet of aluminum foil and attached to the positive terminal of a high voltage generator (Gamma High-Voltage Research, Ormond Beach, Fla.). A voltage of +21 kV was then applied 1 mm from the needle opening, and the scaffold was electrospun as a sheet onto the grounded collector.

Electrospinning Cotton Ball-Like Electrospun Scaffolds

Similar to traditional electrospinning, PCL pellets were dissolved at a ratio of 75 mg/ml in a solvent solution of 1:1 (v:v) chloroform and methanol and transferred to a syringe chamber. The filled syringe fitted with a 25 gauge blunt-tipped needle nozzle was then placed into a syringe pump with a set flow rate of 2.0 ml/hr and at a distance of 15 cm from the front plane of the collector. The nozzle was attached to the positive terminal of a high voltage generator through which a voltage of +15 kV was applied 1 mm from the needle opening, and the three dimensional electrospun scaffold was fabricated onto a custom-made collector.

The collector for the cotton ball-like electrospun scaffolds was specially crafted by embedding an array of 1.5 inch long stainless steel probes in a spherical foam dish (diameter: 8 in., shell thickness: 0.125 in.; Fibre Craft, Niles, Ill.) backed by a stainless steel lining to provide an electrical ground. The needles were placed at 2 inch intervals radiating from the center of the dish in five equidistant directions. The nanofibers were allowed to accumulate throughout the electrospinning process and then removed with a glass rod.

Scaffold Characterization

Scanning Electron Microscope (SEM) Imaging

The ePCL scaffolds were mounted on an aluminum stub and sputter coated with gold and palladium. A Philips SEM 510 (FEI, Hillsboro, Oreg.) at an accelerating voltage of 20 kV was used to image the scaffolds, and the fiber diameters were measured using GIMP 2.6 for Windows.

Confocal Microscope Imaging

To visually contrast nanofiber network organization in the traditional flat-plate electrospun scaffold with the cotton ball-like electrospun scaffold, scaffolds were incubated in 4',6-diamidino-2-phenylindole (DAPI; Invitrogen, Carlsbad, Calif.) for 4 hours. Scaffolds were then imaged using a Zeiss LSM 710 Confocal Laser Scanning Microscope (Thornwood, N.Y.) and analyzed using Zen 2009 software. Since DAPI is strongly attracted to the hydrophobic PCL, the fluorescence clearly illuminated the nanofibrous structures of the scaffolds.

Cell Culturing

INS-1 (832/13) cells, a kind gift from Dr. John A. Corbett (Department of Biochemistry, Medical College of Wisconsin, Milwaukee, Wis.), were cultured in RPMI-1640 media (Invitrogen) supplemented with 10% fetal bovine serum (FBS, Atlanta Biologicals, Lawrenceville, Ga.), 2 mM L-glutamine, 10 mM HEPES, 1 mM sodium pyruvate, and 55 μM 2-mercaptoethanol (Invitrogen). Cells were expanded to 80-90% confluency under normal culture conditions (37° C., 95% relative humidity, 5% $CO_2$) before seeding on the electrospun scaffolds.

The traditional flat-plate ePCL scaffolds were cut into 0.5 cm discs and placed in 96-well plates according to a method described previously [27]. The size of the cotton ball-like ePCL scaffolds were normalized to a 0.5 cm diameter by trimming with a sterile razor and then placed in a 96-well plate. Sterilization was performed by soaking the electrospun scaffolds in a solution of 70% ethanol and 30% phosphate buffered saline (PBS) for 12 hours under sterile conditions, followed by a serial dilution in PBS over 6 hours, and a final soaking in PBS for 12 hours. All scaffolds were then immersed overnight in the media formulation specified above to allow for protein adsorption.

Prior to cell seeding, excess cell culture media from the overnight soaking were removed for all scaffolds. To study cellular infiltration into the scaffolds and measure cellular proliferation, a cell suspension of 64,000 INS-1 cells was added to each scaffold. The scaffolds were incubated for 2 hours in a humidified incubator and then transferred to 48 well tissue culture plates. An additional 400 μl media were added to each well, and the media was changed every 48 hours. Cellular behavior was analyzed by collecting the scaffolds after 1, 3, and 7 days.

Histology

To quantify the extent of cellular infiltration, scaffolds were removed from media at the appropriate time points and fixed in formalin overnight. They were then soaked in a 20% sucrose solution, which was exchanged with a 50% sucrose solution 24 hours later. After soaking overnight, the scaffolds were embedded in Histo-Prep embedding medium (Fisher Scientific, Pittsburgh, Pa.) and snap frozen in liquid nitrogen. The resulting blocks were cut into 20 μm sections using a Microm HM 505E Cryostat with CryoJane Tape-Transfer (Instrumedics, Richmond, Ill.), and mounted onto Superfrost/Plus microscope slides (Fisher Scientific). To visualize cellular nuclei and cytoplasm, the sections were stained with Hemotoxylin and Eosin dyes (American MasterTech Sci., Lodi, CA). Images were then taken using a Nikon eclipse TE2000-S microscope (Melville, N.Y.) and analyzed using NIS-elements AR 2.30 software.

Cell Proliferation Analysis

At the specified time points, cellular proliferation was quantified by using the cell counting kit-8 reagent (CCK-8; Dojindo Molecular Technologies, Rockville, Md.) per manufacturer's instructions. Briefly, at each time point, the CCK-8 reagent was added to the specified well in a 1:10 ratio of the total cell culture volume and incubated for 4 hours in a humidified incubator. Each sample was stored in a 4° C. fridge until all time points were collected. The absorbance (450 nm) for all samples was measured together using a microplate reader (Synergy HK, BIO-TEK Instruments, Winooski, Vt.), and the cell number was calibrated against absorbance standards of known cell concentrations.

Statistical Analysis

All experiments were performed in quadruplicate at least three independent times, and the results presented are representative data sets. All values were expressed as means±standard deviations. All data were compared with one-way ANOVA tests using SPSS software. Tukey multiple comparisons test was performed to evaluate significant differences between pairs. A value of $p<0.05$ was considered statistically significant.

Results and Discussion:

The increasing number of roles for synthetic biomaterials in tissue engineering has precipitated new strategies for creating extracellular matrix (ECM) mimicking microenvironments. Among the many biomaterial fabrication methods currently in use, electrospinning has repeatedly been shown to produce biocompatible polymer scaffolds for a variety of applications [28, 29]. Electrospinning is particularly attractive because it is a versatile and cost-effective method to repeatedly fabricate nanofibrous scaffolds using synthetic means. However, one limiting factor of the existing electrospinning methods is an inability to simultaneously incorporate nanofibrous morphologies, while still maintaining deep interconnected pores within a stable three dimensional network structure. This presents a significant obstacle for cellular infiltration and growth deep into the scaffolds, limiting the potential of electrospun scaffolds. Thus, there is a critical need for new transformative electrospinning strategies that provide an ECM mimicking microenvironment for cell based tissue engineering applications. Therefore, in this study, we developed an electrospun scaffold that incorporates a 1) three dimensional, cotton ball-like structure, 2) loosely packed, uninterrupted mesh of nanofibers, 3) deep, interconnected pores in all three dimensions, and 4) good structural stability.

The basic method to electrospin polymer fibers is to place a grounded collector near a charged syringe nozzle, which contains a conductive polymer solution. As the applied voltage is increased, the solution overcomes the frictional forces, resulting in a spinning jet of polymer fluid being ejected from the needle. This ejected solution evaporates as it travels over the projected distance, depositing a mesh of fibers on the collector (FIG. 2.1*a*). The resulting fiber characteristics are largely determined by the solution viscosity, flow rate, and distance between nozzle and collector. (Low viscosities, low flow rates, and large distances generally result in smaller diameters.) However, the overall scaffold characteristics are largely determined by the collector.

On a traditional flat-plate collector, the grounded charge is spread uniformly over a large area. As a result, a group of fibers is deposited side-by-side in one layer, and each subsequent layer is deposited on top of the existing layers. However, each layer is still strongly attracted to the grounded collector, thus compressing the layers below. This creates a flat, sheet-like structure with densely packed fiber layers and superficial, planar pores, which do not continue deep into the scaffold (FIG. 1.2*a*). While the accumulated fiber layers do provide a thickness to the scaffold, the lack of space between adjacent layers essentially creates a two dimensional scaffold, especially since cellular growth and infiltration are limited to the superficial layers.

Therefore, to create an electrospun scaffold with nanofibrous morphologies and deep, interconnected pores incorporated within a more realized three dimensional structure, we replaced the traditional collector with a non-conductive spherical dish that has an array of embedded metal probes (FIG. 2.1*b*). This innovative arrangement evenly dispersed and concentrated the grounded charge on the probes. The probes are then able to collect the nanofibers between them in mid-air, and the lack of a uniform charge throughout the collector allows nanofiber layers to settle next to the previously deposited layers without compressing the scaffold. In addition, the spherical dish helps collect the nanofibers in a focused area, thereby accumulating them as a fluffy, three-dimensional structure with good stability (FIG. 2.2*b*).

Comparing FIGS. 2.2*a* and 2.2*b*, it is clear that modifying the collector system has a dramatic influence on overall scaffold characteristics. As a result of the uniformly concentrated charge of the traditional collector, the generated scaffold has a very tightly packed structure assembled as in a flat, sheet-like arrangement. In contrast, the spherical dish and metal array collector creates a Focused, Low density, and Uncompressed nanoFibrous (FLUF) mesh with tremendous three dimensional depth. Thus, the collector provides an alternative strategy for overcoming one of the current challenges facing electrospinning fabrication, as new scaffolds were created with a stable, interconnected nanofibrous architecture in multiple planes. Herein, we have designated these new three dimensional assemblies as FLUF scaffolds, which very closely resemble the macrostructure of a cotton ball (FIG. 2.2*c*). As an added benefit, the cotton ball-like electrospun scaffolds generated for this study took less than 20 minutes to accumulate, whereas it typically takes many hours, maybe even days, to collect a similarly dimensioned scaffold using the traditional fabrication method.

Poly (ϵ-caprolactone) (PCL) was chosen as the model polymer for this study because it is biocompatible and been FDA approved for use in biomedical applications. Furthermore, PCL can be readily electrospun into nanofibers (ePCL), which can support the growth of chondrocytes, skeletal muscle cells, smooth muscle cells, endothelial cells, fibroblasts, and human mesenchymal stem cells [10, 15, 27, 30-35]. For this study, we evaluated the biological response of the ePCL electrospun scaffolds with a rat insulinoma INS-1 (832/13) cells (INS-1 cells) cell line. INS-1 cells are a very robust cell line that allow for quick and easily obtained biological analysis. Furthermore, this cell line was developed to mimic β-cell function [36-38], which has great utility for studying pancreatic tissue engineering applications, a rapidly emerging area of interest. Thus, to accurately compare nanofiber characteristics and cellular performance in this study, PCL was electrospun using both the traditional flat-plate collector and our spherical dish and metal array collector, followed by biological evaluation of both scaffold types with INS-1 cells.

ECM functionality is highly regulated by complex cellular interactions with different fibrillar proteins that perform biological activities at the nanoscale dimension [39-42]. Furthermore, numerous reports have demonstrated a positive influence of nanofibrous biomaterial structures on cellular activity [15, 43]. Hence, the scaffold parameters designed for this study were specifically chosen to create electrospun nanofibers that were similar in scale to native ECM macromolecules. As demonstrated in FIG. 2.3, the majority of fiber diameters in the traditional ePCL scaffolds were between 300-400 nm, while the cotton ball-like ePCL scaffolds displayed fiber morphologies with an approximate diameter of 500 nm. Therefore, both of these were within the typical size range of collagen fiber bundles found in native ECM [44]. Additionally, even with the different parameters (PCL concentration, flow rate, and voltage), the 2D and 3D nanofiber characteristics were similar. However, the overall scaffold morphologies were significantly affected by the collectors: the traditional collector generated a tightly packed fibrous network, while the new collector was able to create an uncompressed, loosely packed, and more porous nanofibrous structure.

While the influence of nanofiber diameters on cellular behavior is well established, the effect of pore sizes is not so clear. For cellular growth and vascularization in bone, pore sizes of >300 μm have been recommended [45], while fibroblasts have been shown to prefer a pore size of 6-20 μm [16]. Even though optimal pore size is tissue-specific, a minimum threshold for porosity with interconnectivity throughout is still needed within tissue engineered scaffolds to ensure that localized cells and nutrients have access to the internal environment, thereby creating an ECM-like three dimensional structure. However, traditional electrospinning is not conducive to the simultaneous production of fibers at the nanoscale size with large pore size interconnectivity. Previously, this has resulted in the traditional electrospun scaffolds requiring post-fabrication modifications. However, these modifications typically alter the nanofiber characteristics and scaffold stability [20, 21, 24, 25]. Additionally, previous efforts for modifying electrospun scaffolds have focused on superficial, planar pores, rather than multi-planar pores to allow for increased cellular infiltration. Consequently, this study provides a comparative look at the fabrication and increased benefit of multi-planar pores via our cotton ball-like ePCL scaffolds in relation to superficially porous scaffolds as generated by traditional electrospinning means.

To identify the superficial pore characteristics, we imaged both scaffolds with a scanning electron microscope (SEM). Examining the SEM images in FIG. 2.3, the nanofiber densities in the two scaffolds can be easily differentiated; there were significantly fewer nanofibers occupying the same space in the cotton ball-like ePCL scaffold compared to the traditional ePCL scaffold. Furthermore, the traditional ePCL scaffold consistently displayed pores <1 μm, while the cotton ball-like ePCL scaffold had a typical pore size between 2-5 μm. We believe that the increased pore sizes in the cotton ball-like scaffold will allow cells enough room to deeply infiltrate the scaffold, while still providing the needed interconnectivity to bridge the pores across multiple nanofibers.

While the SEM images analyzed the superficial regions of both electrospun scaffold types, questions still remained about the internal structure and arrangement. Specifically, qualitative analysis of the nanofibrous characteristics deep within the scaffolds were still needed. Addressing this issue, we decided to incubate the ePCL samples in DAPI. When illuminated at a wavelength of 360 nm, the resulting fluorescence was able to clearly show the contours of the nanofibrous morphologies. Thus, we used confocal microscopy under a fluorescent filter to study the morphologies of both scaffold types throughout their thicknesses. As demonstrated in FIG. 2.4, the traditional ePCL scaffold had a very tightly packed nanofibrous structure, whereas the cotton ball-like ePCL scaffold had a much more open structure throughout its depth. These contrasting nanofiber characteristics demonstrate the effect of the significantly different collector systems used; the spherical dish and metal array collector helped accumulate the nanofibers in an uncompressed manner, which allowed for more separation between subsequent nanofiber layers. Remarkably, the traditional ePCL scaffolds could only be imaged to a depth of ~10 μm, while the cotton ball-like ePCL scaffolds enabled viewing at a depth up to ~35 μm. This indicated that the increased density of the traditional ePCL scaffold prevented the excitation light from the confocal microscope from deeply penetrating the scaffold. Conversely, the less-dense and more porous cotton ball-like ePCL scaffold was more apt to deeper confocal penetration. This stark contrast in confocal microscopy imaging further verifies the advantageous design of the un-dense, loosely packed network structure of the cotton ball-like scaffolds for cellular infiltration compared to the dense, tightly packed nature of traditional scaffolds. To the best of our knowledge, this combination of an uninterrupted network of nanofibers coupled with deep, multi-planar pores in a stable three dimensional structure has never been demonstrated before in an as-spun, unmodified electrospun scaffold.

An ideal tissue engineered scaffold should promote both good cellular attachment and infiltration, and the balanced combination of both is needed to eventually promote whole tissue formation. Achieving this balance in electrospun scaffolds, though, has proven to be elusive. Specifically, traditionally electrospun scaffolds allow cells to attach superficially; however, they do not provide the large pore sizes needed for substantial cellular infiltration [7, 19, 46]. In addition, current modification techniques to improve infiltration have been found to impede scaffold stability [23, 25]. Thus, as described above, we have designed a spherical dish and metal array collector that is capable of successfully combining nanofibrous morphologies with deep pores in a stable cotton ball-like structure. To identify and contrast cellular responses on the traditional and cotton ball-like ePCL scaffolds, we seeded INS-1 cells and studied their infiltration and growth. To evaluate the cellular response, both scaffolds (each with a diameter of 0.5 cm) were seeded with 64,000 cells, which is ~90% confluence on the top surface. This encouraged cell growth to be directed into the scaffold, thereby demonstrating the relative capacity for in-growth within both scaffold types.

INS-1 cells on the traditional ePCL scaffolds did not infiltrate below the most superficial layer, even after 7 days, whereas cells on the cotton ball-like ePCL scaffolds gradually infiltrated deep into the scaffold (FIG. 2.5). On day 1, the INS-1 cells had attached to the surface of the cotton ball-like ePCL scaffold, and their infiltration was limited to the top surface (FIG. 2.5*b*). By day 3, most of the cells had infiltrated past the superficial threshold (~125 μm), and a few had even infiltrated deep into the scaffold to a depth of ~260 μm (FIG. 5*d*). Furthermore, by day 7, cells were present throughout the scaffold at a depth of ~300 μm from the surface, and the number of cells had increased tremendously, both near the surface and deep within the scaffold (FIG. 2.5*f*). These promising results correlated directly to the more open, loosely packed network structure shown in FIG. 2.4*b*, which allowed the cells an easier path for deep infiltration and greater cell proliferation. In contrast, the tightly packed structure of traditional ePCL scaffolds (FIGS. 2.4*a,c,e*,) presents obstructions that limit cell attachment to the top-most surface layer.

Next, the cellular response was qualitatively evaluated, and as shown in FIG. 2.6, cell growth between days 1 and 3 was similar on both the traditional and cotton ball-like ePCL scaffolds. The cell number on the traditional ePCL scaffolds increased to 123.18±6.23% on day 3 (as normalized to the cell number on day 1), while the cotton ball-like ePCL scaffolds increased to 130.69±25.49%. The most striking change, though, was observed between days 3 and 7. Over this time, the cell number increased to 137.35±3.14% on day 7 (as normalized to Day 1) on the traditional ePCL scaffolds, whereas the value for the cotton ball-like ePCL scaffolds jumped to 178.96±37.09%. These results, combined with the qualitative histology images in FIG. 2.5, strongly demonstrate the influence of the cotton ball-like ePCL scaffold for increasing cellular infiltration and growth. Because of the high initial seeding density, cells on the traditional ePCL scaffolds quickly proliferated to fill the available space on the top surface of the scaffold by day 3, after which the growth rate slowed due to poor cellular infiltration. Hence, there was only ~11% growth between days 3 and 7 on the traditional ePCL scaffold. Meanwhile, the greater thickness and more open, porous nanofibrous network of the cotton ball-like ePCL scaffolds with three dimensionality (FIG. 2.2*b*) allowed space for continuous cellular infiltration (FIGS. 2.5*b*, 2.5*d*, and 2.5*f*) and growth throughout, resulting in the number of attached cells increasing ~37% between days 3 and 7. These cumulative data conclusively prove that the cotton ball-like ePCL scaffolds provide a better host environment for cellular infiltration and growth than the traditional ePCL scaffolds.

CONCLUSION

Current electrospinning techniques do not simultaneously provide deep, interconnected pores within a stable, three-dimensional nanofibrous structure. To address this problem, we have developed an electrospinning technique using a dish with an embedded array of metal probes to create a focused accumulation of ePCL nanofibers that assemble together in a cotton ball-like structure. SEM and confocal microscopy showed a more porous and spacious nanofiber scaffold. Histology and quantitative cell growth demonstrated increased cell penetration and proliferation for the cotton ball-like scaffold over the traditional ePCL scaffold. This strategy provides a new solution for overcoming the current challenges facing the electrospinning process and has great potential across a wide range of tissue engineering applications.

References each of which is incorporated herein by reference

[1] Gupta D, Venugopal J, Mitra S, Dev V G, Ramakrishna S, Nanostructured biocomposite substrates by electrospinning and electrospraying for the mineralization of osteoblasts. Biomaterials. 2009; 30(11):2085-94.

[2] Shin M, Yoshimoto H, Vacanti J. In vivo bone tissue engineering using mesenchymal stem cells on a novel electrospun nanofibrous scaffold. Tissue Eng. 2004; 10(1-2): 33-41.

[3] Zhang Y, Venugopal J, El-Turki A, Tamakrishna S, Su B, Lim C. Electrospun biomimetic nanocomposite nanofibers of hydroxyapatite/chitosan for bone tissue engineering. Biomaterials. 2008; 29(32):4314-22.

[4] Tortelli F, Cancedda R. Three-Dimensional Cultures of Osteogenic and Chondrogenic Cells: A Tissue Engineering Approach to Mimic Bone and Cartilage In Vitro. Eur Cells Mater. 2009; 17:1-14.

[5] Chen J, Xu J, Wang A, Zheng M. Scaffolds for tendon and ligament repair: review of the efficacy of commercial products. Expert Rev Med. Devic. 2009; 6(1):61-73.

[6] Kumbar S, Nukavarapu S, James R, Nair L, Laurencin C. Electrospun poly(lactic acid-co-glycolic acid) scaffolds for skin tissue engineering. Biomaterials. 2008; 29(30): 4100-7.

[7] Zhu X, Cui W, Li X, Jin Y. Electrospun fibrous mats with high porosity as potential scaffolds for skin tissue engineering. Biomacromolecules. 2008; 9(7):1795-801.

[8] Prabhakaran M, Venugopal J, Ramakrishna S. Mesenchymal stem cell differentiation to neuronal cells on electrospun nanofibrous substrates for nerve tissue engineering. Biomaterials. 2009; 30(28):4996-5003.

[9] Feng Z, Chu X, Huang N, Wang T, Wang Y, Shi X, et al. The effect of nanofibrous galactosylated chitosan scaffolds on the formation of rat primary hepatocyte aggregates and the maintenance of liver function. Biomaterials. 2009; 30(14):2753-63.

[10] Venugopal J, Ma L L, Yong T, Ramakrishna S. In vitro study of smooth muscle cells on polycaprolactone and collagen nanofibrous matrices. Cell Biol Int. 2005; 29(10): 861-7.

[11] Jun I, Jeong S, Shin H. The stimulation of myoblast differentiation by electrically conductive sub-micron fibers. Biomaterials. 2009; 30(11):2038-47.

[12] Shin M, Ishii O, Sueda T, Vacanti J P. Contractile cardiac grafts using a novel nanofibrous mesh. Biomaterials. 2004; 25(17):3717-23.

[13] Wray L, Orwin E. Recreating the microenvironment of the native cornea for tissue engineering applications. Tissue Eng Pt A. 2009; 15(7):1463-72.

[14] Pham Q P, Sharma U, Mikos A G. Electrospinning of Polymeric Nanofibers for Tissue Engineering Applications: A Review. Tissue Eng. 2006; 12(5):1197-211.

[15] Li W J, Jiang Y J, Tuan R S. Chondrocyte Phenotype in Engineered Fibrous Matrix is Regulated by Fiber Size. Tissue Eng. 2006; 17(7):1775-85.

[16] Lowery J, Datta N, Rutledge G. Effect of fiber diameter, pore size and seeding method on growth of human dermal fibroblasts in electrospun poly(epsilon-caprolactone) fibrous mats. Biomaterials. 2010; 31(2):491-504.

[17] Patlolla A, Collins G, Arinzeh T L. Solvent-dependent properties of electrospun fibrous composites for bone tissue regeneration. Acta Biomater. 2010; 6(1):90-101.

[18] Eichhorn S J, Sampson W W. Statistical geometry of pores and statistics of porous nanofibrous assemblies. J R Soc Interface. 2005; 2(4):309-18.

[19] Thorvaldsson A, Stenhamre H, Gatenholm P, Walkenstrom P. Electrospinning of highly porous scaffolds for cartilage regeneration. Biomacromolecules. 2008; 9(3):1044-9.

[20] Kim T, Chung H, Park T. Macroporous and nanofibrous hyaluronic acid/collagen hybrid scaffold fabricated by concurrent electrospinning and deposition/leaching of salt particles. Acta Biomaterialia. 2008; 4(6):1611-9.

[21] Nam J, Huang Y, Agarwai S, Lannutti J. Improved Cellular Infiltration in Electrospun Fiber via Engineered Porosity. Tissue Eng. 2007; 13(9):2249-57.

[22] Wei H-J, Chen C-H, Lee W-Y, Chiu I, Hwang S-M, Lin W-W, et al. Bioengineered cardiac patch constructed from multilayered mesenchymal stem cells for myocardial repair. Biomaterials. 2008; 29(26):3547-56.

[23] Yang X, Shah J D, Wang H. Nanofiber Enabled Layer-by-Layer Approach Toward Three-Dimensional Tissue Formation. Tissue Eng Pt A. 2009; 15(4):945-56.

[24] Baker B M, Gee A O, Metter R B, Nathan A S, Marklein R A, Burdick J A, et al. The potential to improve cell infiltration in composite fiber-aligned electrospun scaffolds by the selective removal of sacrificial fibers. Biomaterials. 2008; 29(15):2348-58.

[25] Ekaputra A, Prestwich G, Cool S, Hutmacher D. Combining Electrospun Scaffolds with Electrosprayed Hydrogels Leads to Three-Dimensional Cellularization of Hybrid Constructs. Biomacromolecules. 2008; 9(8):2097-103.

[26] Baker S C, Atkin N, Gunning P A, Granville N, Wilson K, Wilson D, Southgate J. Characterisation of electrospun polystyrene scaffolds for three-dimensional in vitro biological studies. Biomaterials. 2006; 27(16): 3136-46.

[27] Tambralli A, Blakeney B, Anderson J, Kushwaha M, Andukuri A, Dean D, et al. A hybrid biomimetic scaffold composed of electrospun polycaprolactone nanofibers and self-assembled peptide amphiphile nanofibers. Biofabrication. 2009; 1(2):025001.

[28] Murugan R, Ramakrishna S. Design strategies of tissue engineering scaffolds with controlled fiber orientation. Tissue Eng. 2007; 13(8):1845-66.

[29] Yang S, Leong K F, Du Z, Chua C K. The design of scaffolds for use in tissue engineering: I. Traditional Factors. Tissue Eng. 2001; 7(6):679-89.

[30] Choi J S, Lee S J, Chris G J, Atala A, Yoo J J. The influence of electrospun aligned poly(epsilon-caprolactone)/collagen nanofiber meshes on the formation of self-aligned skeletal muscle myotubes. Biomaterials. 2008; 29(19):2899-906.

[31] Li W J, Danielson K G, Alexander P G, Tuan R S. Biological response of chondrocytes cultured in three-dimensional nanofibrous poly(epsilon-caprolactone) scaffolds. J Biomed Mater Res A. 2003; 67(4):1105-14.

[32] Li W J, Tuli R, Okafor C, Derfoul A, Danielson K G, Hall D J, et al. A three-dimensional nanofibrous scaffold for cartilage tissue engineering using human mesenchymal stem cells. Biomaterials. 2005; 26(6):599-609.

[33] Ma Z, He W, Yong T, Ramakrishna S. Grafting of gelatin on electrospun poly(caprolactone) nanofibers to improve endothelial cell spreading and proliferation and to control cell orientation. Tissue Eng. 2005; 11(7-8):1149-58.

[34] Yoshimoto H, Shin Y M, Terai H, Vacanti J P. A biodegradable nanofiber scaffold by electrospinning and its potential for bone tissue engineering. Biomaterials. 2003; 24(12):2077-82.

[35] Zhang Y Z, Venugopal J, Huang Z M, Lim C T, Ramakrishna S. Characterization of the surface biocompatibility of the electrospun PCL-collagen nanofibers using fibroblasts. Biomacromolecules. 2005; 6(5):2583-9.

[36] Asfari M, Janjic D, Meda P, Li G, Halban P A, Wollheim C B. Establishment of 2-mercaptoethanol-dependent differentiated insulin-secreting cell lines. Endocrinology. 1992; 130(1):167-78.

[37] Hohmeier H E, Mulder H, Chen G, Henkel-Rieger R, Prentki M, Newgard C B. Isolation of INS-1-derived cell lines with robust ATP-sensitive K+ channel-dependent and -independent glucose-stimulated insulin secretion. Diabetes. 2000; 49(3):424-30.

[38] Yang S, Fransson U, Fagerhus L, Hoist L S, Hohmeier H E, Renstrom R, et al. Enhanced cAMP protein kinase A signaling determines improved insulin secretion in a clonal insulin-producing deta-cell line (INS-1 832/13). Mol. Endocrinol. 2004; 18(9):2312-20.

[39] Daley W P, Peters S B, Larsen M. Extracellular matrix dynamics in development and regenerative medicine. J Cell Sci. 2008; 121(Pt 3):255-64.

[40] Hubbell J A. Materials as morphogenetic guides in tissue engineering. Curr Opin Biotechnol. 2003; 14(5):551-8.

[41] Kleinman H K, Philip D, Hoffman M P. Role of the extracellular matrix in morphogenesis. Curr Opin Biotechnol. 2003; 14(5):526-32.

[42] Streuli C. Extracellular matrix remodeling and cellular differentiation. Curr Opin Cell Biol. 1999; 11(5):643-40.

[43] Kwon I K, Kidoaki S, Matsuda T. Electrospun nano- to microfiber fabrics made of biodegradable copolyesters:

structural characteristics, mechanical properties and cell adhesion potential. Biomaterials. 2005; 26(18):3929-39.

[44] Elsdale T, Bard J. Collagen substrata for studies on cell behavior. J. Cell Biol. 1972; 54(3):626-37.

[45] Karageorgiou V, Kaplan D. Porosity of 3D biomaterial scaffolds and osteogenesis. Biomaterials. 2005; 26(27): 5474-91.

[46] Telemeco T A, Ayres C, Bowlin G L, Wnek G E, Boland E D, Cohen N, et al. Regulation of cellular infiltration into tissue engineering scaffolds composed of submicron diameter fibrils produced by electrospinning. Acta Biomater. 2005; 1(4):377-85.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'".

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

What is claimed is:

1. An electrospinning apparatus, comprising a device that a fiber is drawn from, wherein the tip of the device from where the fiber is drawn is at a first potential, and a structure that includes a plurality of conductive probes, wherein each probe has a distal end, wherein a portion of each probe extends from a non-conductive surface of the structure, wherein a first set of the distal ends are recessed relative to a second set of distal ends, wherein the first set and the set of distal ends form a first boundary of a target volume, wherein a second boundary of the target volume is not bound by the distal ends of the plurality of the probes, wherein the device is positioned adjacent the second boundary, wherein the conductive probes are at second potential, wherein there is a potential difference between the first potential and the second potential that causes the fiber to be directed to the target volume through the second boundary.

2. The apparatus of claim 1, wherein the first set of the distal ends are further away from the tip of the structure than the second set of the distal ends.

3. The apparatus of claim 1, wherein the first boundary of the target volume has a cross-sectional shape selected from: a substantially concave shape, a substantially cone shape, a substantially hemi-spherical shape, a substantially semi-spherical shape, an arcuate shape, a semi-polygonal shape, a substantially V-shape, a substantially C-shape, and a substantially U-shape, wherein the first set of the distal ends are further away from the tip of the structure than the second set of the distal ends.

4. The apparatus of claim 1, wherein the first boundary of the target volume has a three dimensional shape selected from: a substantially cone shape, a substantially hemi-spherical shape, and a substantially semi-spherical shape, wherein the first set of the distal ends are further away from the tip of the structure than the second set of the distal ends.

5. The apparatus of claim 1, wherein the non-conductive surface is a flat surface.

6. The apparatus of claim 5, wherein the plurality of probes includes at least two groups of probes that are the not same length.

7. The apparatus of claim 1, wherein the non-conductive surface is a non-flat surface.

8. The apparatus of claim 7, wherein the non-conductive surface has a cross-sectional shape selected from: a substantially concave shape, an arcuate shape, a substantially V-shape, a substantially C-shape, and a substantially U-shape.

9. The apparatus of claim 7, wherein the non-conductive surface has a three-dimensional shape selected from: a substantially cone shape, a substantially hemi-spherical shape, a substantially semi-spherical shape, wherein the first set of the distal ends are further away from the tip of the structure than the second set of the distal ends.

10. The apparatus of claim 9, wherein the plurality of probes are the same length.

11. The apparatus of claim 10, wherein the plurality of probes includes at least two groups of probes that are the not same length.

12. The apparatus of claim 1, wherein the plurality of probes are at the same potential.

13. The apparatus of claim 1, wherein the one or more of the plurality of probes are at the different potential than one or more of the other of the plurality of probes.

14. The apparatus of claim 1, wherein the target volume has a longest dimension and a second dimension that is perpendicular the longest dimension at the widest point, wherein the longest dimension is about 5 to 50 cm, wherein the second dimension is about 3 to 50 cm, and wherein the target volume is about 15 to 2500 $cm^3$.

15. The apparatus of claim 1, wherein the plurality of probes includes about 0.1 to 4 probes per square cm.

16. The apparatus of claim 1, wherein each probe has a length that extends from the non-conductive surface of the structure that is about 0.5 to 10 cm, wherein the diameter of the probe is about 100 μto 0.5 cm.

17. The apparatus of claim 1, wherein the device includes a syringe.

18. The apparatus of claim 1, wherein the height of the nonconductive structure is about 5 to 10 cm, wherein the depth of the nonconductive structure is about 5 to 75 cm, and wherein the width of the nonconductive structure is about 5 to 100.

19. A method of forming an uncompressed fibrous mesh, comprising:

applying a potential difference between a tip of a device and a plurality of conductive probes on a structure, wherein each probe has a distal end, wherein a portion of each probe extends from a non-conductive surface of the structure, wherein a first set of the distal ends are recessed relative to a second set of distal ends, wherein the first set and the set of distal ends form a first boundary of a target volume, wherein a second boundary of the target volume is not bound by the distal ends of the plurality of the probes;

drawing a fiber from the tip towards the target volume through the second boundary; and forming the uncompressed fibrous mesh in the target volume.

20. The method of claim 19, wherein the potential is about 5 kV to 60 kV.

21. The method of claim 19, wherein the fiber has a diameter of about 1 to 1000 nm.

22. The method of claim 19, wherein the target volume is about 15 to 2500 $cm^3$.

23. The method of claim 19, wherein the uncompressed fibrous mesh has a volume that is about 50 to 1800 $cm^3$, wherein the fiber occupies about 5 to 20% of the volume of the uncompressed fibrous mesh.

24. The method of claim 19, wherein the potential is about 5 kV to 60 kV, wherein the target volume is about 15 to 2500 $cm^3$, wherein the uncompressed fibrous mesh has a porosity of about 80 to 90%, wherein the uncompressed fibrous mesh has a volume that is about 50 to 1800 $cm^3$, and wherein the fiber occupies about 5 to 20% of the volume of the uncompressed fibrous mesh.

* * * * *